US009892902B2

(12) United States Patent
Furuhashi et al.

(10) Patent No.: US 9,892,902 B2
(45) Date of Patent: Feb. 13, 2018

(54) ION RADIATION DEVICE AND SURFACE ANALYZER USING SAID DEVICE

(71) Applicant: SHIMADZU CORPORATION, Kyoto-shi, Kyoto (JP)

(72) Inventors: Osamu Furuhashi, Kyoto (JP); Hideaki Izumi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/334,559

(22) Filed: Oct. 26, 2016

(65) Prior Publication Data

US 2017/0154764 A1 Jun. 1, 2017

(30) Foreign Application Priority Data

Nov. 26, 2015 (JP) ..... 2015-230616

(51) Int. Cl.

| | |
|---|---|
| ***H01J 49/40*** | (2006.01) |
| ***H01J 49/06*** | (2006.01) |
| ***H01J 49/10*** | (2006.01) |

(52) U.S. Cl.

CPC ..... *H01J 49/401* (2013.01); *H01J 49/062* (2013.01); *H01J 49/10* (2013.01)

(58) Field of Classification Search

CPC ..... H01J 49/401; H01J 49/062; H01J 49/10

(Continued)

(56) References Cited

U.S. PATENT DOCUMENTS 6,040,575 A * 3/2000 Whitehouse ..... B82Y 15/00 250/282
2006/0091308 A1* 5/2006 Boyle ..... H01J 49/107 250/285

(Continued)

FOREIGN PATENT DOCUMENTS

JP 2013-109837 A 6/2013
WO 2012/086630 A1 6/2012

OTHER PUBLICATIONS

"(Technical classification) 2-8-2-1 Mass spectrometry general technology/ distribution measurement/ two dimensional/ MS imaging", Patent Office, "online", search on Oct. 6, 2015, internet <URL: http://www.jpo.go.jp/shiryou/s_sonota/hyoujun_gijyutsu/mass/2-8-2.pdf, 2 pages.

(Continued)

*Primary Examiner* — Nicole Ippolito
(74) *Attorney, Agent, or Firm* — Sughrue Mion, PLLC

(57) ABSTRACT

Used as an ion beam guiding unit for introducing primary ions to the surface of the sample is an ion optical system of reflectron TOFMS for achieving time focusing including an orthogonal acceleration unit for accelerating the ions in the orthogonal direction, a flight space of a non-electric field, and an ion reflector for forming a reflecting electric field. A dual stage type is used as the ion reflector to superimpose the correction potential showing a predetermined non-linear potential distribution on the potential having a linear gradient of a uniform electric field at the side deeper than the second order focusing position that fulfills the Mamyrin solution, thereby correcting the temporal spread of ion packets emitted from the orthogonal acceleration unit until the deviation of third or higher order in energy, achieving high time focusing.

13 Claims, 7 Drawing Sheets

(58) Field of Classification Search
USPC ..... 250/396 R, 397, 287, 492.1, 492.2, 250/492.21, 492.22, 492.23
See application file for complete search history.

(56) References Cited

U.S. PATENT DOCUMENTS

2016/0035552 A1* 2/2016 Verenchikov ..... H01J 49/0031 250/282
2017/0168031 A1* 6/2017 Verenchikov ..... G01N 30/7206

OTHER PUBLICATIONS

W. C. Wiley, et al., "Time-of-Flight Mass Spectrometer with Improved Resolution", Review of Scientific Instruments, Dec. 1955, pp. 1150-1157, vol. 26, No. 12.
B. A. Mamyrin, et al., "The mass-reflectron, a new nonmagnetic time-of-flight mass spectrometer with high resolution", Soviet Physics—JETP, Jul. 1973, pp. 45-48, vol. 37, No. 1.
M. Guilhaus, et al., "Orthogonal Acceleration Time-of-Flight Mass Spectrometry", Mass Spectrometry Reviews, 2000, pp. 65-107, vol. 19.

* cited by examiner

ION RADIATION DEVICE AND SURFACE ANALYZER USING SAID DEVICE

TECHNICAL FIELD

The present invention pertains to an ion radiation device for irradiating ions to a sample for the purpose of analyzing the sample surface and to a surface analyzer, such as secondary ion mass spectrometer using the device for analyzing the surface of the sample.

BACKGROUND ART

A technique called an imaging mass spectrometry is known as one of the techniques to observe the two-dimensional distribution of substances on a sample surface. With the imaging mass spectrometry, laser beam or primary ions serve as primary particles and are irradiated to a sample surface, and according to this irradiation, the ions emitted from the sample surface (secondary ions) are subjected to mass spectrometry. Matrix-assisted laser desorption/ionization-time-of-flight mass spectrometry (MALDI-TOFMS) that combines time-of-flight mass spectrometry (TOFMS) with an ion source by matrix-assisted laser desorption/ionization (MALDI) is generally used as the device that employs a laser beam as primary particles.

The technique of using primary ions as primary particles is called Secondary Ion Mass Spectrometry (SIMS), and as the device therefore, Time-of-Flight Secondary Ion Mass Spectrometry (TOF-SIMS) using a time-of-flight mass analyzer as the mass analyzer is well known. TOF-SIMS has a disadvantage in terms of sensitivity, but is excellent in spatial resolution compared to that of MALDI-TOFMS. For this reason, imaging mass spectrometry that uses TOF-SIMS has been widely used in surface analysis of products and industrial materials such as silicon wafer, and the like.

In the imaging mass spectrometry using TOF-SIMS, the following two imaging techniques are used to obtain the intensity distribution of various ions within a somewhat wide region on a sample (refer to Non-Patent Literature 1).

(1) Scanning-type imaging technique: a primary ion beam is focused to a fine diameter and irradiated on a sample surface, and the sample surface is scanned two dimensionally with the beam so as to move its radiation position on the sample surface. Subsequently, mass spectrometry of the ions emitted from the measurement point on the sample is performed for every measurement point, thereby collecting the mass spectral data on each measurement point within the predetermined region on the sample.

(2) Projection-type imaging technique: The diameter (cross-sectional area) of the primary ion beam is widen to irradiate to the sample surface, and the ions emitted from the wider range on the sample to which the ion beam has been irradiated are guided to a two-dimensional detector so as maintained its two-dimensional positional relationship to be detected. In this way, the mass information and the positional information of the ions emitted from different measurement points on the sample can be obtained simultaneously.

In the scanning-type imaging technique of (1), mass spectrometry needs to be performed sequentially for each of the multiple measurement points, so the time required for measurement becomes long when the region to be measured on the sample is wide. On the contrary, in the projection-type imaging technique of (2), even when the region to be measured on the sample is wide, it is possible to obtain the mass spectral data on all measurement points within the region by one mass analysis. For this reason, this technique has a significant advantage of being able to yield a high measurement throughput due to its ability to shorten the time required for measurement compared to that with the scanning-type imaging technique.

With such TOF-SIMS, secondary ions fly from the sample by the irradiation of primary ions on the sample, and the time of flight is measured using the point at the time the ions start to fly as the starting point. For this reason, the variation of the times of occurrence of the secondary ions on the sample leads to the decrease in mass accuracy and mass resolution in the data obtained. Therefore, primary ions are generally pulsed to irradiate on the sample. This is the same as irradiating to the sample a pulsed laser beam in MALDI-TOFMS.

However, when the pulse width of the ion beam is made to be narrow in order to suppress the temporal spread of the primary ions, the amount of the primary ions becomes low, deteriorating the detection sensitivity. On the other hand, when the pulse width is made to be wider, the amount of the primary ions increases, widening the temporal spread. For these reasons, in either the scanning-type imaging technique or the projection-type imaging technique, it becomes necessary to increase the amount of ions irradiated to the sample as much as possible while suppressing its temporal spread.

In TOF-SIMS by the projection-type imaging technique, primary ions in a thin sheet form in their travelling direction is irradiated to the sample. In this case, when there is a deviation in the arrival time of the primary ions arrived at multiple measurement points on the sample, a variation in the time of occurrence of the secondary ions occurs in each measurement point. For this reason, in order to acquire an accurate mass spectrometric imaging image, not only it is necessary to suppress as much as possible the temporal spread of the primary ions at arrival at each measurement point, but it is also necessary to suppress the deviation of the arrival time of ions among different measurement points within the region subjected to the measurement. That is, the primary ions in a thin sheet form need to simultaneously arrive at the region subjected to the measurement on the sample.

One of the factors which cause the deviation in the arrival time of the primary ions among the measurement points is that the optical path length of each ion is different according to the location within the cross section of one ion packet. This difference is due to that the primary ion beam which spreads spatially is irradiated to the sample surface from the diagonal direction. In order to solve this problem, a technique of deflecting the trajectory of the primary ions is employed in the TOF-SIMS disclosed in Patent Literature 1. According to this technique, it is able to suppress the variation in the arrival time of the primary ions to the sample surface among different measurement points occurred due to the difference in the optical path length of the primary ions from the primary ion generating part until the sample surface.

However, the technique described above, as described in paragraph (0045) of the Patent Literature 1, does not solve the problem of variation in the arrival time (that is, the temporal spread of the ion beam) caused by the spatial variation of the position existed in each ion at the time of irradiation from the primary ion generation unit. The temporal spread of the ion beam caused by such factor actually exits from hundreds of nsec to several usec. For this reason, even if the temporal variation due to the difference in the optical path length of the ion has been corrected, in order to obtain a sufficiently high mass resolution in TOFMS, it is difficult to fulfill the strict requirements of the pulse width of the primary ion beam to be about several nsec or less.

In order to realize a high mass resolution and high mass accuracy in TOF-SIMS using such a projection-type imaging technique, even when the positions of the ions in the travelling direction vary to a certain degree at each position within the cross section of the ion beam when the ions are emitted from the primary ion generation unit, it is important to sufficiently suppress the temporal spread of the ion beam at the time of irradiating the primary ions to the sample surface.

The problems described above apply not only to TOF-SIMS but also to various surface analyzer for detecting those other than ions, for example, light including x-rays, electrons, neutral particles, and the like, emitted from a sample according to the irradiation of ions to the surface of the sample.

PRIOR ART LITERATURES

Patent Literatures (Patent Literature 1) Japanese Unexamined Patent Application Publication 2013-109837

(Patent Literature 2) International Publication No. 2012/086630 gazette

Non-Patent Literature (Non-Patent Literature 1) "(Technical classification) 2-8-2-1 Mass spectrometry general technology/distribution measurement/two dimensional/MS imaging", Patent Office, "online", "search on Oct. 6, 2015", internet <URL: http://www.jpo.go.jp/shiryou/s_sonota/hyoujun_gijyutsu/mass/2-8-2.pdf>

(Non-Patent Literature 2) Wiley (W. C. Wiley), and one other author, "Time-of-flight mass spectrometer with improved resolution", Review of Scientific Instrument (Rev. Sci. Instrum.), Vol. 26, 1955, pp. 1150-1157

(Non-Patent Literature 3) Mamyrin (B. A. Mamyrin), and three other authors, "The mass-reflectron, a new nonmagnetic time-of-flight mass spectrometer with high resolution", Soviet Physics, JETP 37, 1973, p. 45-48

(Non-Patent Literature 4) Guilhaus (M. Guilhaus), and two other authors, "Orthogonal Acceleration Time-of-flight Mass Spectrometry", Mass Spectrometry Review (Mass Spectrom. Rev.), Vol. 19, 2000, p. 65-107

SUMMARY OF THE INVENTION

Problem to be Solved by the Invention

The present invention was made to solve the problems described above, and the first objective of the present invention is to provide an ion radiation device capable of suppressing the temporal variation of ions that arrive on the sample surface when the ions are irradiated to the sample to analyze the sample surface.

Furthermore, the second objective of the present invention is not only to suppress the temporal spread of ions at one ion irradiation point (i.e., measurement point) but also to suppress the variation in the arrival time of ions among different ion irradiation points in an ion radiation device for irradiating ions in a wide range on the sample for performing a surface analysis such as imaging mass spectrometry, and the like, by means of projection-type imaging technique in particular.

Yet another objective of the present invention is to improve the resolution and accuracy of the analysis by suppressing the temporal variation of ions that arrive on the sample surface in the surface analyzer of TOF-SIMS, and the like, for analyzing the sample surface after irradiating ions on the sample.

Means for Solving the Problem

Generally in TOFMS, a constant initial energy is applied to ions derived from the sample component, these ions are accelerated and introduced to a flight space, and a detector is used to detect the ions that fly in the flight space. It is preferable for the ions having the same mass-to-charge ratio to simultaneously arrive at the detector; however, for example, when an initial energy is imparted to the ions that are held in an inner space of an ion trap to be accelerated, or when an initial energy is imparted to the ions that are made incident to the orthogonal acceleration unit to be accelerated in the direction substantially orthogonal to the incident direction, variations are present in the initial positions of the ions accelerated, and these variations may include the variation in the arrival time of ions at the detector. In order to solve this problem, TOFMS (refer to Non-Patent Literature 2) using an ion source of dual-stage acceleration type that fulfills the requirement of Wiley-McLaren and TOFMS (refer to Non-Patent Literature 3) using a reflectron of a dual-stage type proposed by Mamyrin are conventionally known. The inventors of the present invention proposed in Patent Literature 2 a TOFMS that has a configuration close to an ideal reflectron with time focusing of ions higher than those in the existing TOFMS.

These TOFMS, to greater or lesser degree, can suppress the variation of arrival times of the ions at the detector, i.e., improve the time focusing, even when there are the variations in energy due to the variation in the location at the time the ions start to fly. The present inventors focused on the fact that the problem of time focusing of ions that arrive at the detector in such TOF-SIMS is substantially the same as the problem of temporal variation of ions that arrive on the sample surface by the ion radiation device in the TOF-SIMS described above; therefore, the inventors arrived at a conclusion to utilize the configuration of TOFMS intended to increase the time focusing of ions at the detector for the ion radiation device, thus completing the present invention.

The ion radiation device of the present invention made to solve the problems described above is an ion radiation device for irradiating ions to a surface of a sample, equipped with a) a beam formation unit for forming an ion beam consisting of ions having the same mass-to-charge ratio, and b) an ion beam guiding unit for pulsing the ion beam formed by the beam formation unit described above and guiding the beam to the surface of the sample;

wherein the ion beam guiding unit includes b1) an orthogonal acceleration unit for accelerating the incident ion beam in pulses in the direction substantially orthogonal to its travelling direction, b2) a flight space in which the ions accelerated by the orthogonal acceleration unit fly, and b3) a voltage generator for applying a predetermined accelerating voltage to the orthogonal acceleration unit and/or applying a predetermined voltage to an ion reflector arranged in the flight space and in which ions are reflected by the action of the electric field, so as to allow the time focusing of ion packets that are accelerated by the orthogonal acceleration unit, fly in the flight space, and arrived on the surface of the sample.

The ion beam guiding unit in the ion radiation device of the present invention has substantially the same configuration as in the ion optical system of reflectron-type TOFMS or linear-type TOFMS of orthogonal acceleration system, and in place of a detector for detecting ions in these TOFMSs, a structure in which a sample to be analyzed is placed is employed. That is, the ion radiation device of the present invention irradiates on a sample surface ion packets that exist in the ion beam guiding unit, are accelerated by the orthogonal acceleration unit, and fly in the flight space.

When substantially the same structure as the ion optical system of linear-type TOFMS is employed as the ion beam guiding unit, a dual-stage acceleration type orthogonal acceleration unit that fulfills the requirements by Wiley-McLaren (hereinafter may be called Wiley-McLaren-type acceleration unit) may be used. Thereby, the temporal spread of ion packets that fly in the flight space is corrected up to the deviation of the first order in energy, and even when there is a variation in the position having variations in energy in the ion beam incident to the orthogonal acceleration unit, it is possible to suppress to a certain extent the temporal spread of the ion packets at the time the ion packets arrive on the sample surface.

When substantially the same structure as the ion optical system of a reflectron-type TOFMS is employed as the ion beam guiding unit, a dual stage reflectron proposed by Mamyrin may be used. As described in Non-Patent Literature 3 and Patent Literature 2, the dual stage reflectron that fulfills the Mamyrin solution can correct the temporal spread of ion packets that fly in the flight space until the deviation of the second order in energy. For this reason, it is possible to increase the time focusing of the ion packets compared to the case of employing the ion optical system of a linear-type TOFMS using Wiley-McLaren-type acceleration unit described above.

However, the deviation of the third and more order in energy is not corrected even when using a dual-stage-type reflectron that fulfills the Mamyrin solution. Therefore, when the time focusing of the ion packets needs to be further increased, the ideal reflectron described in Patent Literature 2 or a reflectron analogous thereto may be used. Such reflectron has, at least in some portion thereof, a non-linear potential gradient on an ion optical axis in the reflecting electric field by an ion reflector.

To be specific, for example, the voltage generator monotonically changes the potential throughout the ion reflector along the central axis of the ion reflector when the coordinates along the central axis of the ion reflector is X, and as a result, a voltage is applied to the ion reflector so as to form a predetermined potential $U_A$ (X), in which an inverse function $X_A$ (U) is uniquely obtained, in the hollow region of the ion reflector, thereby forming an $N^{th}$ order focusing position at a position of the potential $E_0$ and the coordinate $X_0$ inside the ion reflector, wherein a voltage may be applied to the ion reflector so as to superimpose on the predetermined potential $X_A$ (U) a predetermined correction potential $X_C$ (U) that becomes a smooth function from the coordinate $X_0$ in the back side, and can be approximated with the equation in proportional with $\{U(X)-E0\}^{N+3/2}$ in the vicinity of the coordinate $X_0$, in the space on the back side using the $N^{th}$ order focusing position, which is the coordinate $X_0$, as the starting point.

In this case, the potential gradient on the ion optical axis in the reflecting electric field is non-linear in the range where the correction potential $X_C$ (U) is superimposed.

When the ion reflector is of a dual stage type, the correction potential proportional to $\{U(X)-E0\}^{3.5}$, where N=2, may be superposed in the vicinity of the boundary of the starting point using the second order focusing position inside the ion reflector, or the correction potential proportional to $\{U(X)-E0\}^{2.5}$, where N=1, may be superposed in the vicinity of the boundary of the starting point using the first order focusing position inside the ion reflector.

A reflectron-type TOFMS using such ion reflector can realize a time focusing of ions at the detector after reflected by the ion reflector even when the ions spread spatially at the time of acceleration, thereby it is possible to realize a high mass resolution. Therefore, by placing the sample to be measured in place of a detector, it is possible to realize time focusing of the ions with high accuracy on the surface of the sample.

In the ion radiation device according to the present invention, the beam generation unit includes an ion source for generating primary ions. The ion generating technique in this ion source is not particularly limited; however, for example, a liquid metal ion source, a cluster ion source, a gas field ion source, an ion source using electric discharge can be used. In the case of generating ions having a plurality of mass-to-charge ratios in the ion source, the beam formation unit may have a structure equipped with an ion selection unit for selecting ions having a specific mass-to-charge ratio in various ions generated by the ion source. Various types of mass separators used in a mass spectrometry such as a quadrupole mass filter, or the like, can be used as the ion selection unit.

In the ion radiation device according to the present invention, the ion beam guiding unit further has a centroid adjustment unit for adjusting the spatial centroid of the ion beam; therefore, it may be a structure that can adjust or change the position of irradiated primary ions on the sample surface. Specifically, the centroid adjustment unit can be made as, for example, an adjustment unit for adjusting the initial energy (i.e., an introduction voltage) involving ions when the ions are introduced to the orthogonal acceleration unit, or a voltage generator for applying a predetermined voltage to an electrode and a deflection electrode having a deviated position of ions introduced to the orthogonal acceleration unit.

In the ion radiation device according to the present invention, the beam formation unit may have an ion storage unit for storing ions, wherein it may be a structure in which the ions temporarily stored in the ion storage unit are emitted and introduced to the orthogonal acceleration unit. As the ion storage unit, a linear-type ion trap, or the like, for trapping ions by an electric field can be used.

According to this structure, the ion beam with increased spatial density in the ion storage unit can be sent into the orthogonal acceleration unit; therefore, a large amount of ions can be irradiated on a sample. Thereby, it is possible to improve the sensitivity when observing secondary ions emitted from the sample according to ion radiation.

The ion radiation device according to the present invention may have a structure in which an ion beam focused on a very narrow cross-sectional area is irradiated to a sample; however, it may also be a structure in which ions are simultaneously irradiated to a somewhat wide range, two-dimensionally, on a sample.

For this reason, the ion radiation device according to the present invention may have a structure in which two-dimensionally spread ions are irradiated to a sample, wherein a beam formation unit allows incident of an ion beam with a predetermined width on the orthogonal acceleration unit, the ion beam of which spreads in the direction substantially orthogonal to both the incident direction of ions to the orthogonal acceleration unit and the acceleration direction in the orthogonal acceleration unit, and the orthogonal acceleration unit accelerates in pulses only at a predetermined length the incident ion beam with a predetermined width in its incident direction.

With this structure, ion packets having two-dimensional spread, i.e., in a sheet form, are irradiated to the sample; however, when the surface of the spread of ion is not in parallel with the sample surface, a variation occurs in the ion arrival time at each irradiation position within the ion irradiation surface. Therefore, the ion radiation device according to the present invention is preferred to be equipped with a sample stage for holding a sample and for the sample stage to be tiltable. In this case, the tilting amount and direction of the sample stage may be devised so as to be adjustable by a user. According to this structure, by allowing a user to perform a fine adjustment of the inclination of the sample stage, so that the surface of the sample becomes in parallel with the surface of the spread of the incident ions, it is possible to reduce the deviation of time the ions are irradiated to the sample surface. In addition, even in the case of poor parallelism between the surface and the bottom surface of the sample that is flat (that is, the sample surface is inclined), by tilting the sample stage, it is possible to adjust the surface of the sample to be in parallel with the surface of the spread of the incident ions.

In order to achieve the same effect, instead of tilting the sample stage, the inclination of the surface of the ion packets when injecting ions from an orthogonal acceleration unit may be adjusted. For this purpose, a deflector capable of changing the inclination of ions in the width direction or the angle of ions in the travelling direction introduced to the orthogonal acceleration unit depending on an applied voltage, for example, may be provided in front of the orthogonal acceleration unit, or a voltage applied to an push-out electrode for pushing out ions or a extraction electrode for extracting ions in the orthogonal acceleration unit may be adjusted at the time of introducing the ions to the orthogonal acceleration unit.

The surface analyzer according to the present invention is a surface analyzer using the ion radiation device according to the present invention described above, characterized in that ions (i.e., secondary ions), neutral particles, photons, or phonons emitted as secondary particles from a sample are observed with respect to the ions that are made incident to the surface of the sample by the ion radiation device.

When the ion radiation device for squeezing the above-mentioned ion beam to a very small cross-sectional area and irradiating it to a sample is employed in a surface analyzer, it is possible to observe ions, neutral particles, photons, or phonons emitted from the very small region on the sample to which the ion beam has been irradiated. When such surface analyzer is used for observation with respect to a somewhat wide range on a sample, observation may be carried out in each different position (measurement point) while scanning continuously or in steps the position irradiated by the ion beam on the sample. This is equivalent to an observation by means of the scanning-type imaging technique.

On the other hand, when the ion radiation device for simultaneously irradiating ions two-dimensionally in a somewhat wide range on a sample is used, observation of ions, neutral particles, photons, or phonons in a somewhat wide range on the sample can be carried out all at once. This is equivalent to an observation by means of the projection-type imaging technique.

The surface analyzer according to the present invention is useful in TOF-SIMS for measuring the secondary ions emitted from a sample using time-of-flight mass spectrometry (TOFMS). The reason for this is that, as described above, in order to obtain a high mass resolution and mass accuracy in TOF-SIMS, it is important to sufficiently suppress the temporal spread of its ion beam at the time of irradiating the primary ions to the sample surface; by using the ion radiation device according to the present invention, it is possible to significantly suppress the temporal spread of such ion beam.

Especially, when the ion radiation device for simultaneously irradiating ions two-dimensionally in a somewhat wide range on a sample is used in TOF-SIMS, imaging mass spectrometry with high mass resolution and high mass accuracy with respect to a two-dimensional range on a sample can be carried out in a short period of time.

Effect of the Invention

According to the ion radiation device of the present invention, when irradiating the pulsed ions to a sample, it is possible to suppress the variations of their arrival time at the time of the ion arrival on the sample surface. Thereby, not only it is possible to shorten the time of irradiating ions on the sample surface, but it is also possible to irradiate at further high spatial density, i.e., a large amount of ions in a short time. Therefore, by using the ion radiation device of the present invention in TOF-SIMS, for example, it is possible to improve the deterioration of mass resolution caused by the temporal spread of the primary ion beam, to realize high mass resolution and high mass accuracy, and to improve the measurement sensitivity.

According to the ion radiation device of the present invention, when the ions are irradiated in a somewhat wide range on a sample, it is also possible to suppress the time variation in which each ion arrives at each position within such range. That is, it is possible to irradiate to a sample the ion beam in a sheet form that is spreading spatially almost uniformly in a direction perpendicular to or diagonally with the travelling direction, which is very narrow spatially with respect to the travelling direction of the ion beam. Therefore, by using the ion radiation device of the present invention in TOF-SIMS by a projection-type imaging technique, for example, it is possible to obtain an accurate mass spectrum at each position due to the alignment of the timing the secondary ions fly from each position within the two-dimensional region subjected to measurement on a sample. Thereby, an accurate mass spectrometric imaging image can be acquired.

Furthermore, by using the ion radiation device according to the present invention, for example, it becomes possible to observe a chemical reaction of substances on a solid surface and ions incident at high time resolution of about nanoseconds on a sample surface, and it becomes possible to realize a new surface analyzing technique that cannot be done with the conventional techniques.

DETAILED DESCRIPTION OF THE EXEMPLARY EMBODIMENTS

TOF-SIMS of one example of embodiment of the surface analyzer using the ion radiation device according to the present invention will be described below in details with reference to the accompanying drawings.

Figure 1:
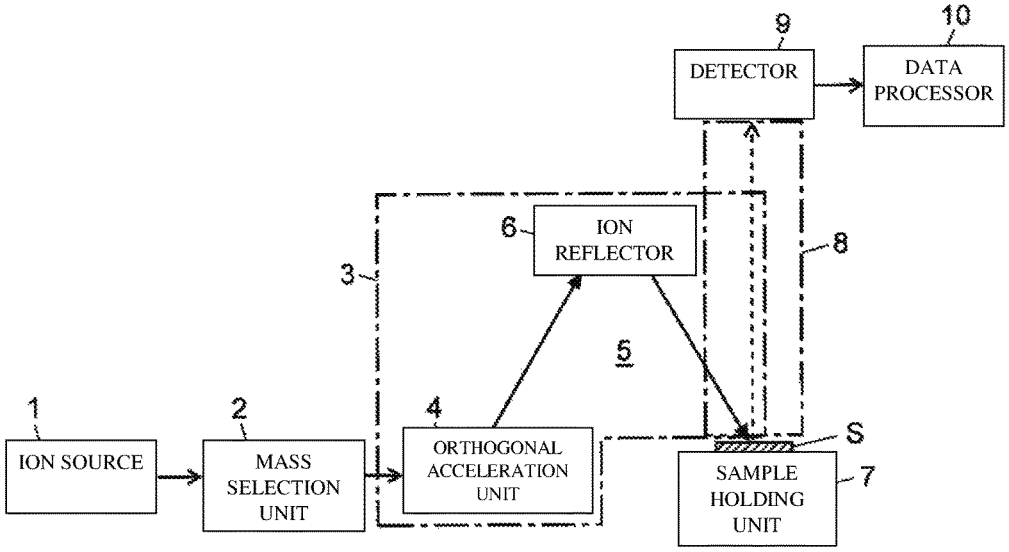
FIG. 1 is an overall configuration diagram of TOF-SIMS in an example of embodiment using the ion radiation device according to the present invention.
Figure 2:
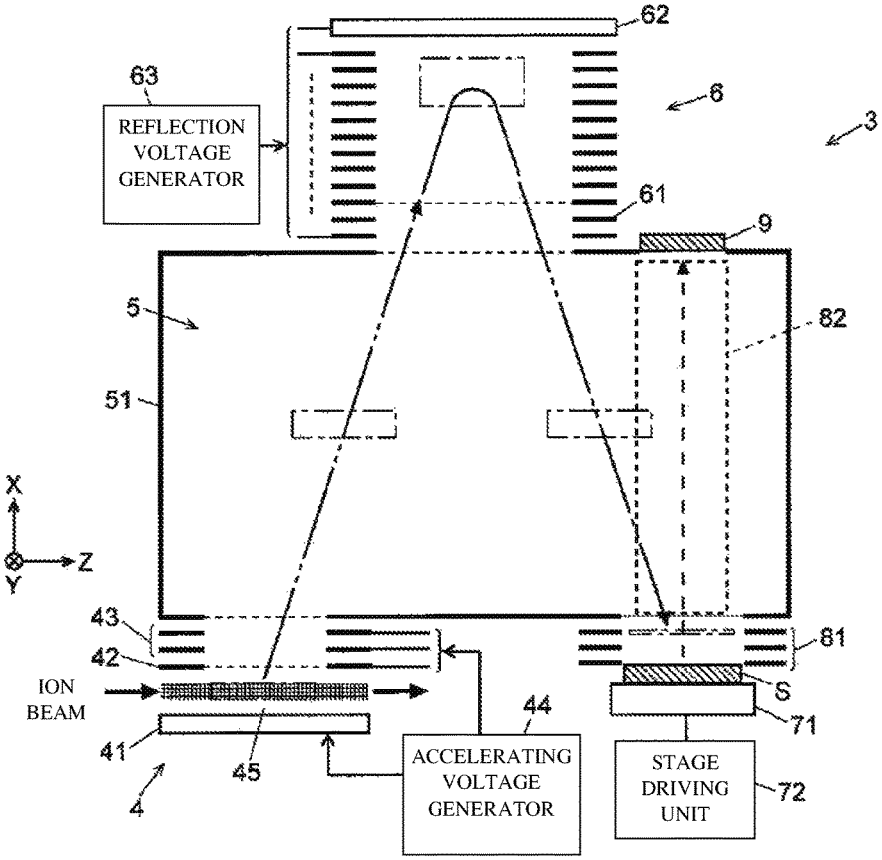
FIG. 2 is a configuration diagram of a beam guiding unit of TOF-SIMS of the example of embodiment.

FIG. 1 is an overall configuration diagram of TOF-SIMS in this example of embodiment, and FIG. 2 is a configuration diagram of a beam guiding unit.

As shown in FIG. 1, TOF-SIMS of this example of embodiment is equipped with an ion source 1 for generating primary ions; a mass selection unit 2 for selecting only ions with a specific mass-to-charge ratio m/z among the ions generated by the ion source 1; an ion beam guiding unit 3 that includes an orthogonal acceleration unit 4, a flight space 5, and an ion reflector 6; a sample holder 7 for holding sample S, which is the subject of measurement; a time-of-flight mass spectrometer 8 for separating secondary ions emitted from the sample S depending on the irradiation of the primary ions according to the mass-to-charge ratio; a detector 9 having a detection surface that is two-dimensionally wide; and a data processor 10 for processing a detection data by the detector 9.

A liquid metal ion source widely used in SIMS, a cluster ion source, a gas field ion source, and various plasma ion sources using a discharge phenomenon can be used as the ion source 1. In addition to a quadrupole mass filter capable of arbitrarily controlling the ratio of the mass-to-charge value or the range of the mass-to-charge ratio of ions to be selected by changing the voltage applied to an electrode, a technique of selecting, by a gate electrode, ions with a specific mass-to-charge ratio from among the ions that have been separated depending on the time of flight corresponding to the mass-to-charge ratio, a technique of selecting ions with a specific mass-to-charge ratio using a magnetic field, or a Wien filter that superimposes the electric field and the magnetic field can be used as the mass selection unit 2. When the mass-to-charge ratios of ions generated by the ion source 1 are uniform, it is not necessary to provide a mass selection unit 2.

The configuration of the ion beam guiding unit 3 and the time-of-flight mass spectrometer 8 will be described in details with reference to FIG. 2.

As shown in FIG. 2, the orthogonal acceleration unit 4 includes a flat push-out electrode 41, a grid-type extraction electrode 42, a plurality of accelerating electrodes 43, and an accelerating voltage generator 44 for applying each predetermined voltage to each electrode 41-43. The ion beam sent in from the mass selection unit 2 in the Z axial direction is introduced to a flat acceleration space 45 between the push-out electrode 41 and the extraction electrode 42 arranged in parallel. At this point, although the spatial spread of the ion beam in the X axial direction is small, it has the spread to a certain extent in the Y axial direction (By is the width of the ion beam in the Y axial direction).

When the respective predetermine DC voltages are applied to the push-out electrode 41 and the extraction electrode 42 from the accelerating voltage generator 44 at a preset timing, an extraction electric field is formed in the acceleration space 45, and the ions that pass through the acceleration space 45 at this time receive an energy in the X axial direction and are extracted outside the extraction electrode 42. The ions are further accelerated in the X axial direction from the accelerating electric field formed by the applied voltage to the accelerating electrodes 43 to fly in the direction where the velocity component in the X axial direction and the velocity component in the Z axial direction merge (the direction inclined in the Z axial direction with respect to the X axial direction). The ion beam in the acceleration space described above is simultaneously accelerated with ions that have a width of By in Y axial direction and a length to a certain degree in the Z axial direction (this length here will be referred to as Bz). Therefore, ion packets in a very thin sheet form (the height in the X axial direction is very small), which is a rectangle of Bz x By, are emitted from the orthogonal acceleration unit 4.

The flight space 5 is formed inside a housing 51 to maintain in a vacuum atmosphere and does not receive external influence of electric field or magnetic field. That is, the flight space 5 is a field free space in which ions fly without being affected by electric field or magnetic field. The ion packets emitted from the orthogonal acceleration unit 4 described above are charged into and fly inside the flight space 5. The ion reflector 6 that includes a plurality of guard-ring electrodes 61, a back plate 62, and a reflected voltage generator 63 is arranged at the back side of the flight space 5 toward the travelling direction of the charged ions, and the ion packets are reflected by a reflecting electric field formed by this ion reflector 6. The reflected ion packets then fly again inside the flight space 5 and finally arrive at the surface of the sample S. The sample holder 7 includes a sample stage 71 that is movable in five axial directions (X, Y, Z, $\Theta$, and $\varphi$) and on which the sample S is placed on the surface, and a stage driving unit 72 including a driving mechanism of a motor, or the like, for moving the sample stage 71 in each five axial direction described above.

The time-of-flight mass spectrometer 8 has a linear configuration including an accelerating electrode 81 arranged on top of the sample S and a flight space 82 formed inside the housing 51. That is, when the ion packets in a sheet form as described above are irradiated to the sample S as primary ions, secondary ions originating from various components existed on the surface of the sample S fly from the sample S. These secondary ions receive a certain initial energy by an accelerating electric field formed by the voltage applied to the accelerating electrode 81 from a voltage generator, not shown in the drawing, to be sent to the flight space 82, which is a non-electric and non-magnetic field. The secondary ions that fly in the flight space 82 are separated depending on the mass-to-charge ratio, and the secondary ions having different mass-to-charge ratios arrive at the detector 9 having a time lag.

The secondary ions fly from the entire two-dimensional region on the sample S irradiated with the primary ions; however, these secondary ions fly while almost maintaining the positions in the Z axial direction and Y axial direction and arrive at the detector 9. The detector 9 detects the secondary ions that arrive in a state of being two-dimensionally spread for each of their positions and outputs the detection data depending on the amount of ions arrived. Therefore, the data processor 10 can acquire a spectrum data showing the relationship between the ion intensity and the time of flight for each position having different coordinates (Z, Y) on the sample S, and obtain the mass spectrum data by converting the time of flight to the mass-to-charge ratio. And a mass spectrometric imaging image at any mass-to-charge ratio is created based on this mass spectrum data.

As such, the TOF-SIMS of the present example of embodiment is a TOF-SIMS capable of imaging mass spectrometry by means of a projection-type imaging technique.

In such TOF-SIMS, the primary ions irradiated on the surface of the sample S preferably fulfill the following requirements.

(1) The spreads of ion packets in the Z axial direction and the Y axial direction irradiated on the surface of the sample S are from about several mm to about several cm, and the ions inside the ion irradiation region are to have a uniform distribution as much as possible.

(2) All ions contained in the ion packets, which are in a sheet form, focused on a surface parallel with the surface of the sample S are to simultaneously arrive on the surface of the sample S. That is, the time focusing of ion is high at each different position inside the ion irradiation region, and the arrival time of ion at each position is to be as small as possible (provided that the surface of the sample S is flat).

The requirements no. (2) above are especially important in achieving high mass resolution and high mass accuracy. In the TOF-SIMS of the present example of embodiment, using an ideal reflectron (refer to Patent Literature 2) for orthogonal acceleration-type mass analyzer developed by the present inventors for the ion beam guiding unit 3 realizes high time focusing of ions on the surface of the sample S.

First, the key points of one example of the reflectron-type TOFMS using the ideal reflectron will be described with reference to FIG. 3. "The ideal reflectron" here is the one in which energy focusing is possible up to an infinite higher order of terms regarding the spread of time of flight at a certain energy $E_0$ or greater with complete isochronous energy being the most important. The time of flight T(E) of ions, where E is an initial energy, in TOFMS can be represented by the following equation (1).

$$T(E)=T(E_0)+(dT/dE)(E-E_0)+(1/2)(d^2T/dE^2)\cdot(E-E_0)^2+(1/6)(d^3T/dE^3)(E-E_0)^3+\ldots \quad (1)$$

Complete isochronous refers to the terms of first and all subsequent differential coefficients in equation (1) becoming 0.

Figure 3:
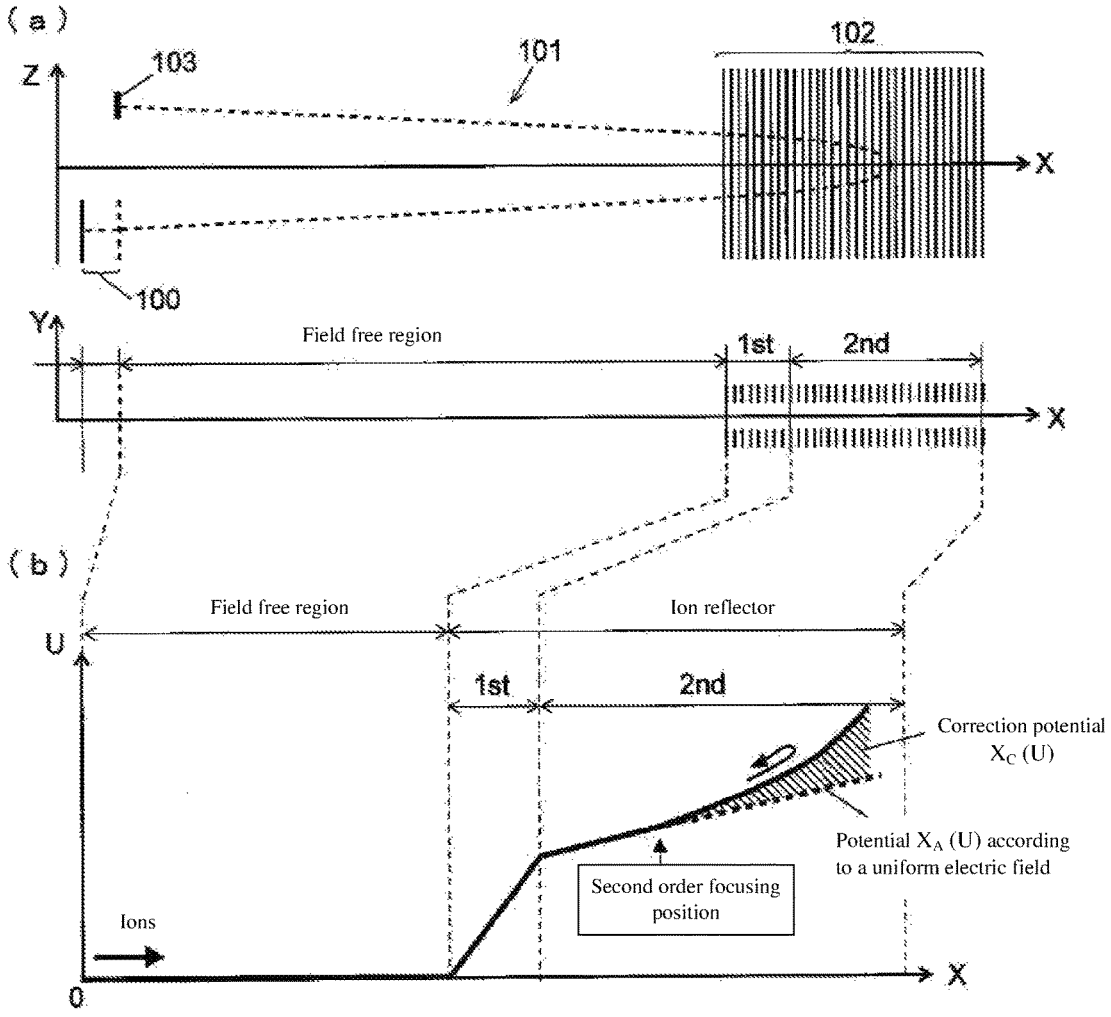
FIG. 3 at (a) is a schematic diagram of a reflectron-type TOFMS used in the beam guiding unit of the TOF-SIMS of the example of embodiment, and at (b) is a drawing illustrating a schematic potential distribution on the ion optical axis.

FIG. 3 at (a) is a schematic diagram of a reflectron-type TOFMS, having a configuration in which the top portion shows Z-X planes on which the ion trajectory rests and the bottom portion shows Y-X planes. The ions receive an initial energy at an accelerating region 100 to fly in a non-electric field flight space 101. And then the ions are reflected by an ion reflector 102, returned to the non-electric field accelerating region 101, and arrive at the detector 103. FIG. 3 at (b) shows a schematic potential distribution on the ion optical axis.

This reflectron is based on the dual stage reflectron proposed by Mamyrin. The ion reflector in the dual stage reflectron is configured by a uniform electric field of two stages, where 1st denotes the first stage and 2nd denotes the second stage in FIG. 3. The potential distribution in the first stage of the non-electric field flight space 101 and the ion reflector 102 is as shown by the solid line in FIG. 3 at (b). The potential distributions in the second stage of the ion reflector 102 are as shown by straight solid and dashed lines in FIG. 3 at (b). That is, the electric fields in the first and second stages are both uniform electric fields, so the potential gradient is linear, and the inclination of the straight line is different in the first stage and the second stage. As has been well known, with this configuration, it is possible to correct the spread of time of flight at the time the ions arrive at the detector 103 until the second derivative of the energy the ions have, by appropriately determining the potential gradient of each stage, that is, the electric field. That is, the first and second order differential coefficients in equation (1) become 0. However, in this case, the third order and subsequent differential coefficients do not become 0. The potential distribution $X_A$ (U) of the optimized model in the uniform electric field of two stages as described above is called a base potential.

On the contrary, with the ideal reflectron developed by the present inventors, the correction potential $X_C$ (U) properly calculated is superimposed on the base potential $X_A$ (U), and the sum of the potential $X_R$ (U)=$X_A$ (U)+$X_C$ (U) is made so as to fulfill complete isochronism. In order to prevent disturbance to the time focusing until the second order is achieved by Mamyrin solution, the second order focusing position in the Mamyrin solution determined in the second stage is made as the starting point of superimposing the correction potential $X_C$ (U), and the correction potential $X_C$ (U) is superimposed only on the back side from this position. The detailed invention is omitted, but the theoretical correction potential $X_C$ (U) is expressed by the following equation (2).

(Mathematical formula 1)

$$X_C(U)=\frac{1}{2\pi\sqrt{2}}\int_1^U \frac{T_D(1)-T_D(E)}{\sqrt{U-E}}dE \quad (2)$$

Ideally, the correction potential X (U) in the vicinity of the point from which the superimposing of the correction potential $X_c$(U) starts is approximated by the power of 3.5, which is a half-integer. That is, $$X_C(U)\propto(U-1)^{3.5}.$$

It is possible to realize complete isochronism of ions reaching the detector 103 by determining the voltage applied to each guard-ring electrode that constitutes the ion reflector 102 so that the electric field having the potential distribution added with the correction $X_C$ (U) described above to the base potential $X_A$ (U) is formed inside the ion reflector 102.

Similarly in a single stage reflectron that achieves first order focusing by a uniform electric field at a single stage that fulfills the requirements of Wiley-McLaren instead of a dual stage reflectron, by superimposing the correction potential on the base potential, it is possible to realize an ideal reflectron. However, the correction potential, which is non-linear, of the dual stage reflectron can be small, so the effect of time aberrations due to divergence and off-axis of undesired ions is easy to suppress.

The ideal reflectron described above realizes a complete isochronism of ions when the ions emitted from the acceleration region 100 arrive at the detector 103; therefore, basically by replacing the detector 103 onto a sample S, it is possible to realize time focusing of ions at the surface of the sample S. However, in the case of TOFMS as shown in FIG. 3 at (a), as opposed to the path of ions coming out from the ion reflector 102 until reaching the detector 103 being a non-electric field, as shown in FIG. 2, in the TOF-SIMS of the present example of embodiment, an accelerating electric field for secondary ion extraction by the accelerating electrode 81 is formed in the upper space of the sample S, and the primary ions also pass through that accelerating electric field. For this reason, the potential distribution inside the ion reflector 6 for realizing the complete isochronism of ions is calculated also by taking the effect of the accelerating electric field into consideration.

Even when the ion packets in a very thin sheet shape arrive at the sample S, if the surface of the spread of those ion packets is not parallel with the surface of the sample S, the times the ions arrive become vary according to their position within the surface, leading to the deterioration of the mass resolution of the secondary ions. Therefore, in TOF-SIMS of the present example of embodiment, by properly tilting the sample stage 71 by the stage driving unit 72, it is possible to secure the parallelism between the surface of the sample S and the surface of the spread of ion packets, which are the primary ions. Specifically, a user may simply perform a fine adjustment of the inclination of the sample stage 71 so as to make the width as small as possible, that is, to make the mass resolution as good as possible, while observing the width of a peak having a predetermined mass-to-charge ratio in the secondary ion spectrum.

Next, the potential distribution on the entire ion flight path when using the configuration of the ideal reflectron described above in the ion beam guiding unit 3 and a simulation for proving its effect will be described.

Figure 4:
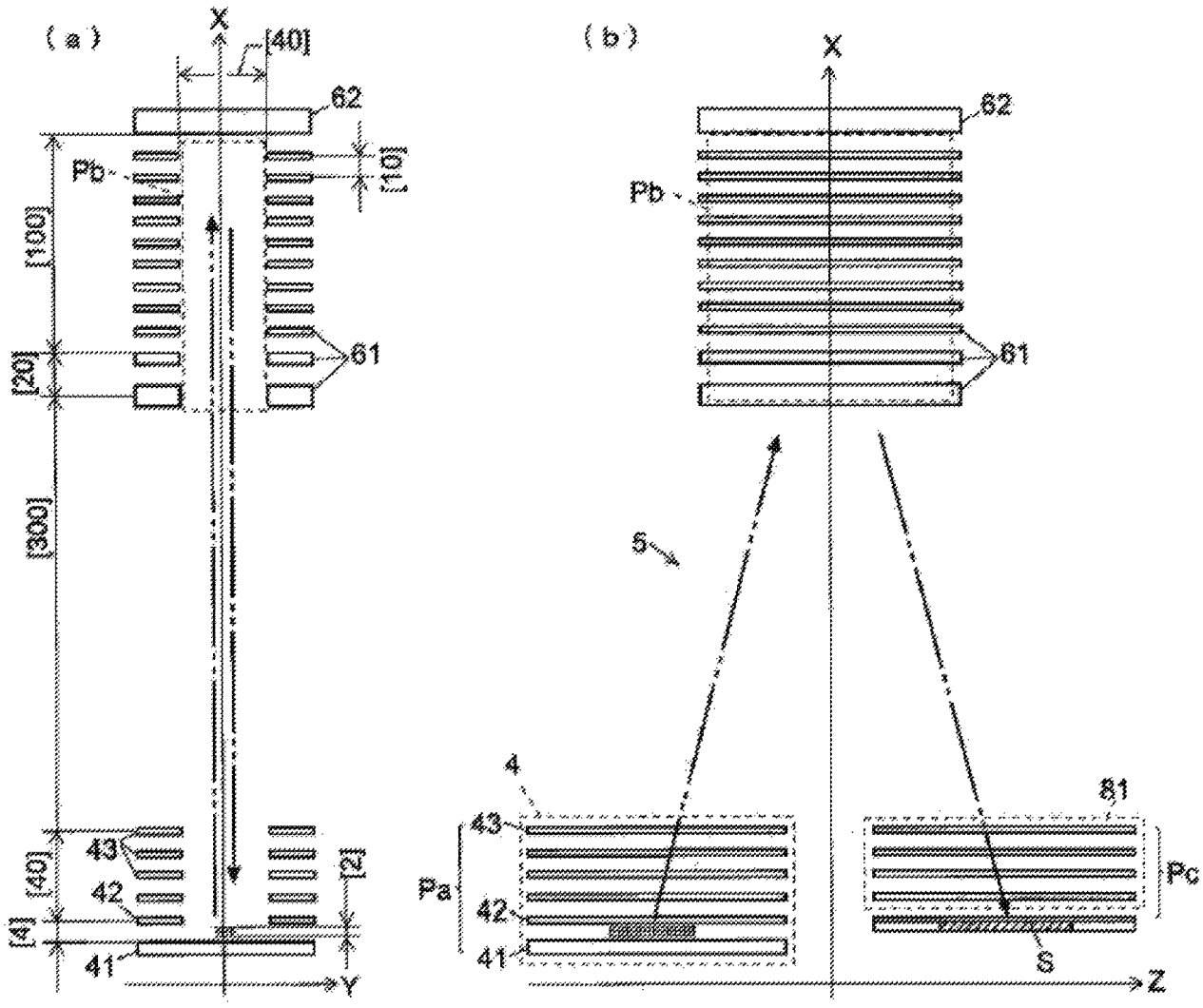
FIG. 4 is a configuration diagram of the beam guiding unit assumed during a simulation for confirming the time focusing of the ion beam in TOF-SIMS of the example of embodiment.
Figure 5:
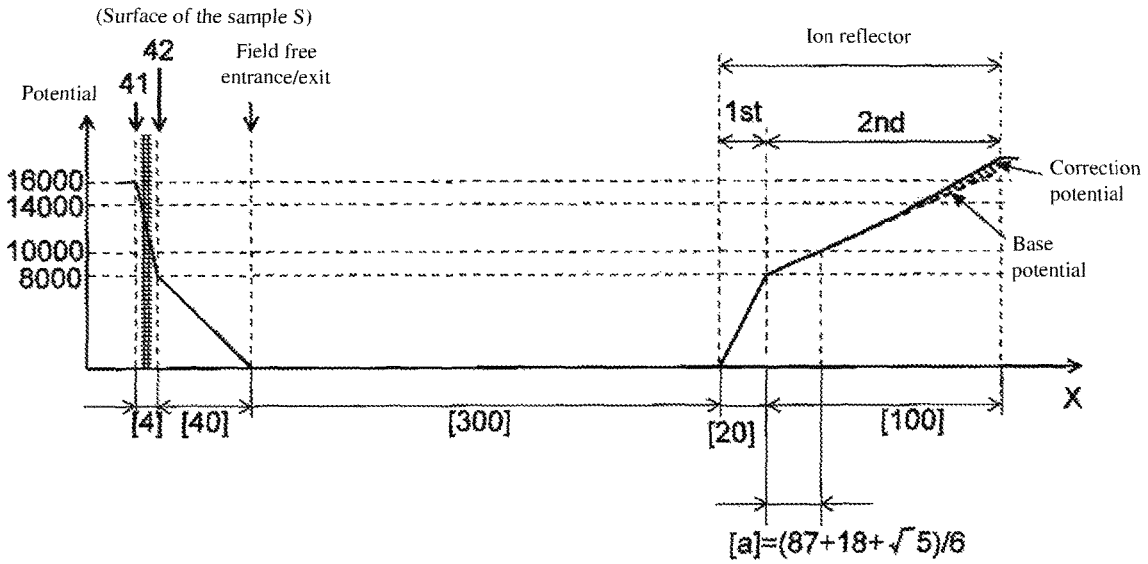
FIG. 5 is a drawing illustrating the calculation results of the potential distribution on all ion flight path in the beam guiding unit shown in FIG. 4.
Figure 6:
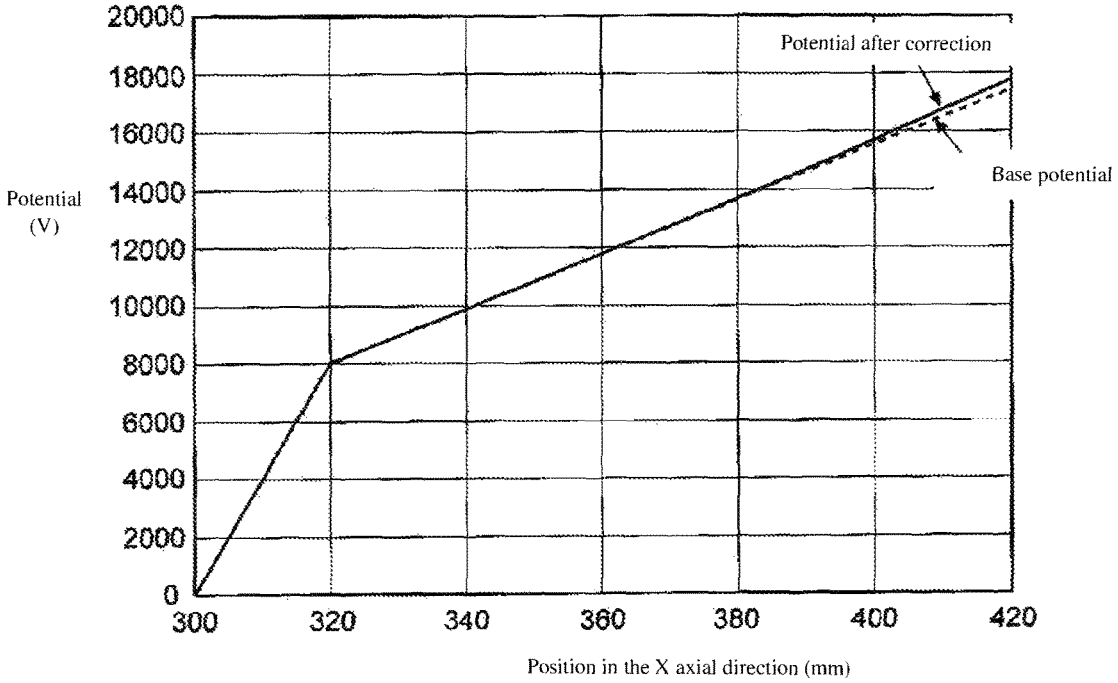
FIG. 6 is a drawing illustrating the results of the detailed calculation of the potential distribution in the reflectron of the beam guiding unit shown in FIG. 4.

FIG. 4 is a drawing illustrating the geometric shape and arrangement of electrodes of the beam guiding unit 3 assumed during a simulation calculation of the ion trajectory, FIG. 5 is a drawing illustrating the potential distribution on all ion flight path in the structure shown in FIG. 4, and FIG. 6 is a drawing illustrating the detailed potential distribution in the ion reflector 6 shown in FIG. 5. In FIG. 4 and FIG. 5, the numerical values indicating the size (the unit is mm) for distinguishing it from the references indicating each part are denoted in brackets.

As for regions in which ions are accelerated or decelerated other than the free flight space of a non-electric field, there are three regions, which are an acceleration region Pa for initially accelerating ions, a reflection region Pb for reflecting the ions after the ions discharged from the acceleration region Pa pass through the flight space 5, which is a non-electric field, and a sample holding region Pc for irradiating the ions to the surface of the sample S after the reflected ions pass through the flight space 5 again. The ions in the acceleration space 45 in the acceleration region Pa progress at an initial energy Ez=600 eV in the Z axial direction. The gap between the push-out electrode 41 and the extraction electrode 42 is 4 mm, and the ions are accelerated in the X axial direction by the voltages applied to the electrodes 41 and 42 and the voltage applied thereafter to the accelerating electrode 43 arranged in a region having 40 mm in length in the X axial direction.

Suppose that the initial spread of ions in the X axial direction in the acceleration space 45 is 2 mm. The ions that fly inside the flight space 5 have a kinetic energy of 10.6-14.6 keV in width due to the difference in the initial positions of ions in the X axial direction. These ions fly in the flight space 5 again after being reflected by the ion reflector 6 in the reflection region Pb (however, the depth of penetration into the reflection region Pb differs depending on the energy the ions have). As described above, an electric field for accelerating the generated secondary ions having a low initial kinetic energy is always formed in the sample holding region Pc. For this reason, as shown in FIG. 5, when primary ions, which are of positive polarity, are made to incident to sample S, and secondary ions, which are of positive polarity, are emitted from the sample S, the primary ions towards the sample S receive a decelerating force as they advance in the sample holding region Pc.

As described above, when calculating the potential distribution inside the ion reflector 6 for realizing the isochronism of ions on the surface of the sample S, the decelerating electric field in the sample holding region Pc is also taken into consideration. Specifically, a secondary focusing condition (a, p) that fulfills Mamyrin solution is obtained (where a represents the position of the second order focusing point, and p represents the ratio of ion energy lost at the first stage of the ion reflector), so that the time of flight with respect to the ions with energy exceeding 10 keV becomes equal, in accordance with the technique described in Patent Literature 2; a non-linear correction potential in a region deeper than the position of the second order focusing point ($a=\{87+18\sqrt{(5)}\}/6$) (where $p=4/5$) is obtained, and this is added to the base potential having a linear potential gradient to calculate the ideal potential distribution. As can be seen from FIG. 6, simply by making the potential gradient after correction to be slightly curved, the deviation from the linear potential is minimal.

Figure 7:
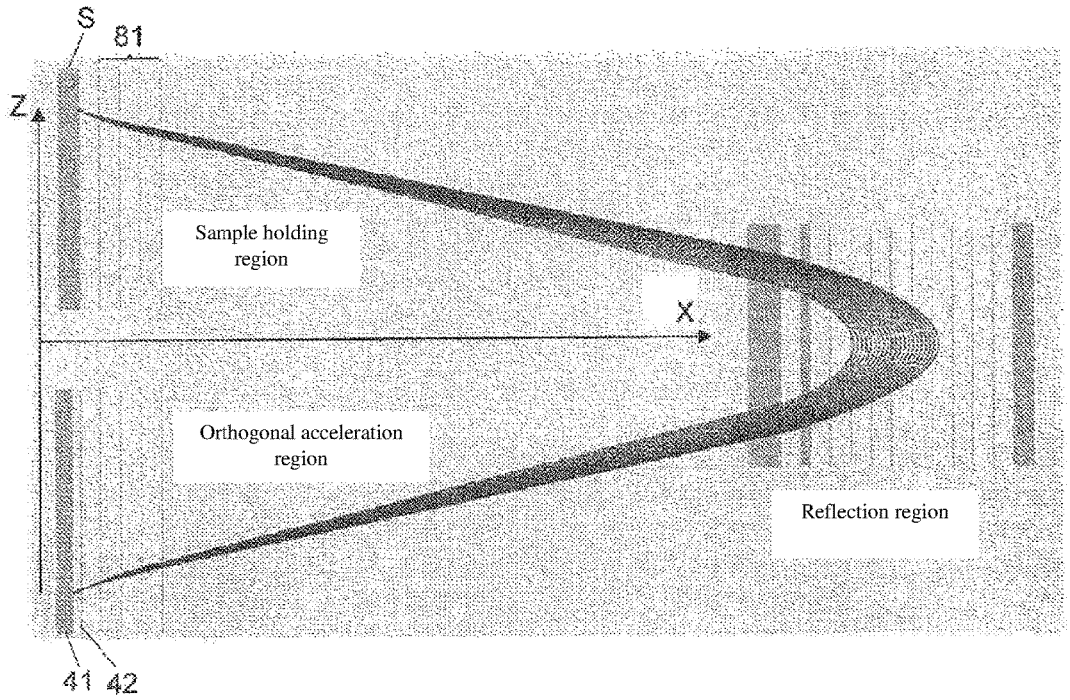
FIG. 7 is a drawing illustrating the simulation results of the ion trajectory from the orthogonal acceleration unit until the sample surface.
Figure 8:
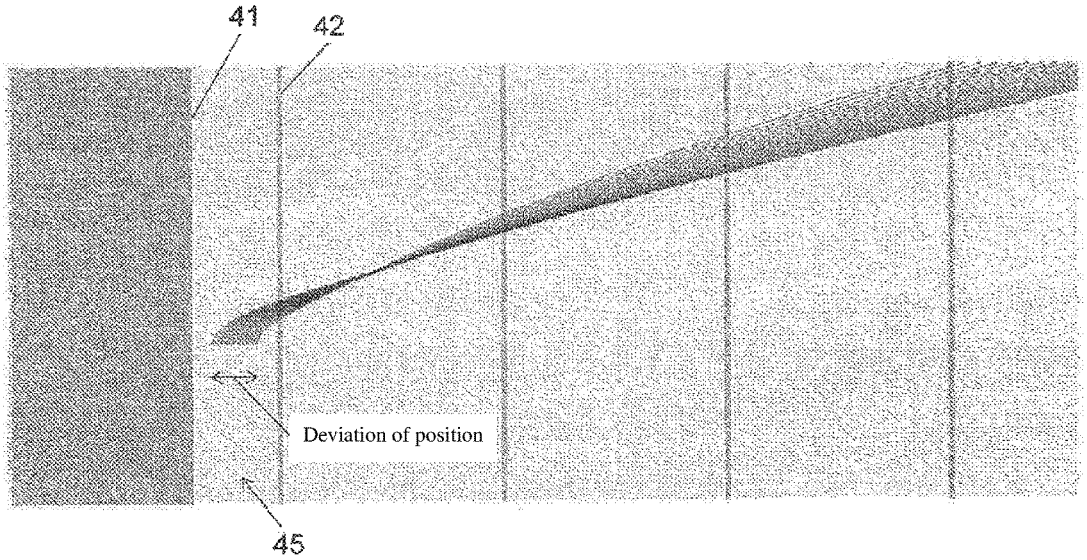
FIG. 8 is an enlarged view of the ion trajectory in the vicinity of the orthogonal acceleration unit.
Figure 9:
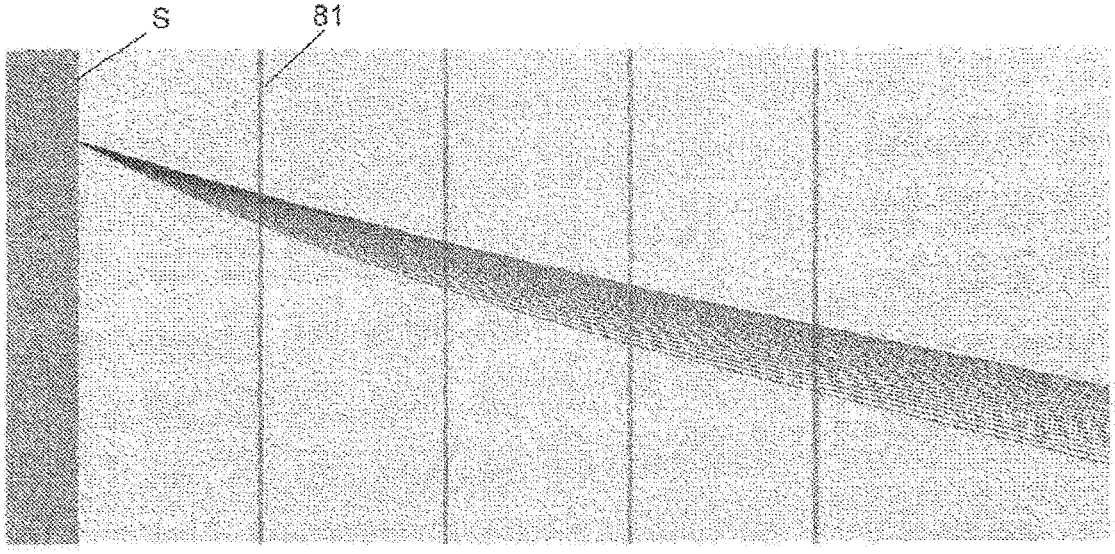
FIG. 9 is an enlarged view of the ion trajectory in the vicinity of the sample surface.

The results of investigating whether the isochronism of ions is actually achieved using a simulation of ion trajectory are shown in FIG. 7 to FIG. 9. FIG. 7 is a drawing illustrating the ion trajectory from the orthogonal acceleration unit 4 until the surface of the sample S, FIG. 8 is an enlarged view of the ion trajectory in the vicinity of the orthogonal acceleration unit 4, and FIG. 9 is an enlarged view of the ion trajectory in the vicinity of the surface of the sample S.

In the simulation calculation, suppose that the ions, wherein m/z=1000, fly in the acceleration space 45 in the Z axial direction at an initial kinetic energy of 600 eV, and the kinetic energy of ions at the time of incident to a free flight space varies at a width of 10.6-14.6 keV by the difference in the initial position in the X axial direction. The ions come out from the accelerating region Pa, are reflected in the reflection region Pb, and arrive at the sample holding region Pc, during which uniform motion continues in the Z axial direction. For this reason, when the time of flight becomes equal with respect to the ion packets having a kinetic energy in the flight space 5 of 10.6-14.6 keV in width, all ions with position deviation in FIG. 8 should arrive at the same Z coordinate position on the surface of the sample S. Actually, the fact that all ions emitted from different positions in the X axial direction arrived at one point, i.e., the same Z coordinate position, on the surface of the sample S can be confirmed from the results shown in FIG. 9. That is, this means that the ideal ion isochronism is realized. According to the results of such simulation, it can be confirmed that the time of flight is contained in the range of deviation within 1 nsec focusing on 21.858 μsec with respect to the ion packets having a width (the width of kinetic energy) of the initial position in X axial direction. That is, it was confirmed that isochronism at high level can be realized.

Figure 10:
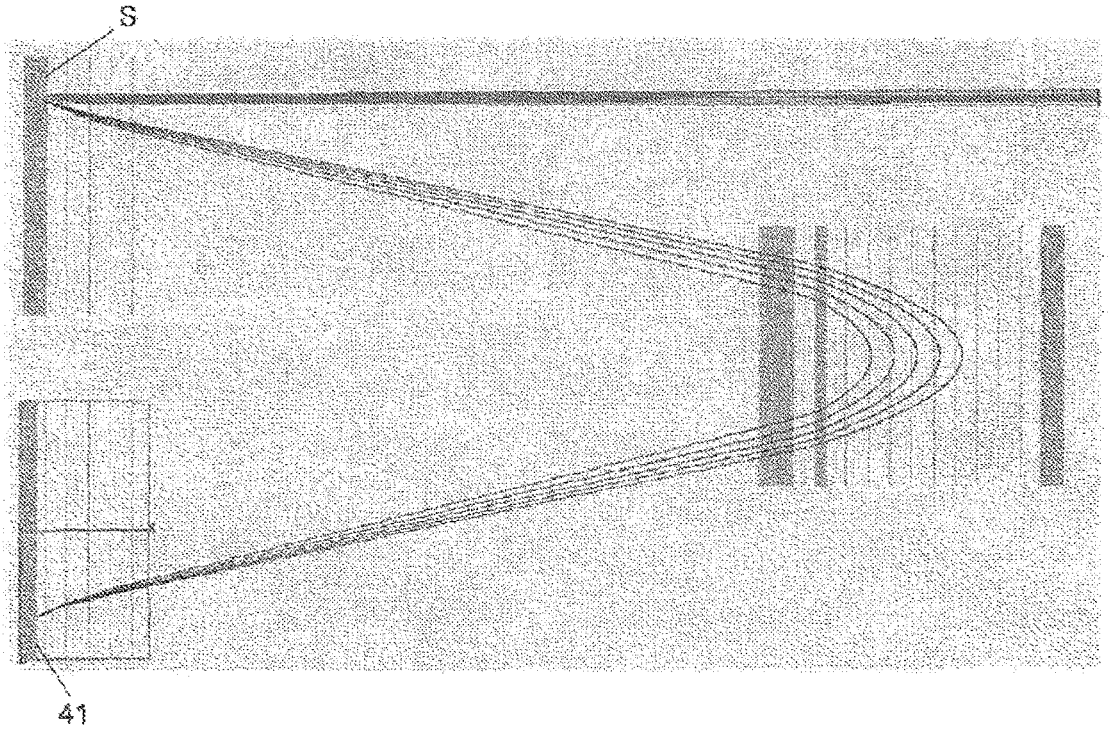
FIG. 10 is a drawing illustrating the simulation results of the trajectory of secondary ions emitted from the sample surface with respect to the incident of the primary ions.
Figure 11:
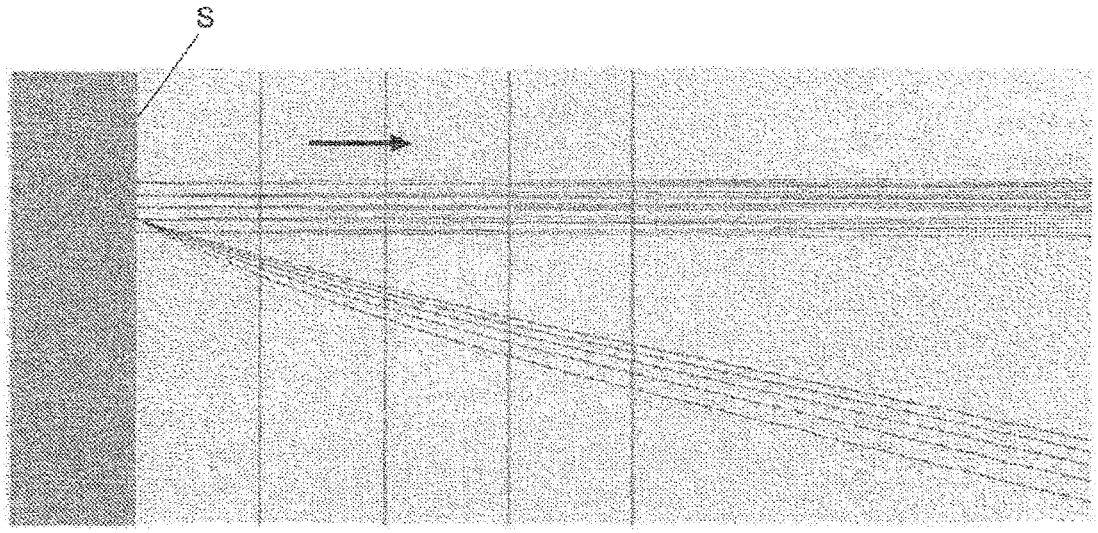
FIG. 11 is an enlarged view of the secondary ion trajectory in the vicinity of the sample surface.

The simulation results of the trajectory of secondary ions occurred when the primary ions collided on the surface of the sample S as described above are shown in FIG. 10 and FIG. 11. FIG. 11 is an enlarged view of the secondary ion trajectory in the vicinity of the surface of the sample S shown in FIG. 10. Here, it is assumed that the secondary ions, wherein m/z=500, are separated from the surface of the sample S at an angle of spread of ±10° at an initial energy of 2 eV. The state of the ions emitted from the surface of the sample S passing through the sample holding region Pc while almost maintaining the initial position distribution can be confirmed from FIG. 10 and FIG. 11. Therefore, it was found that it is possible to realize TOF-SIMS by means of the projection-type imaging technique by arranging a proper ion imaging lens immediately after the sample holding region Pc and then detecting the ions using a position-sensitive detector.

In the example of embodiment described above, the ideal reflectron capable of realizing high ion isochronism with respect to the ion packets having a wide spread of energy was used as the ion beam guiding unit 3, as disclosed in Patent Literature 2. However, the ideal reflectron may not necessarily be used as long as the tolerance of the temporal spread of the ion packets that arrive on the surface of the sample S is widened.

Figure 12:
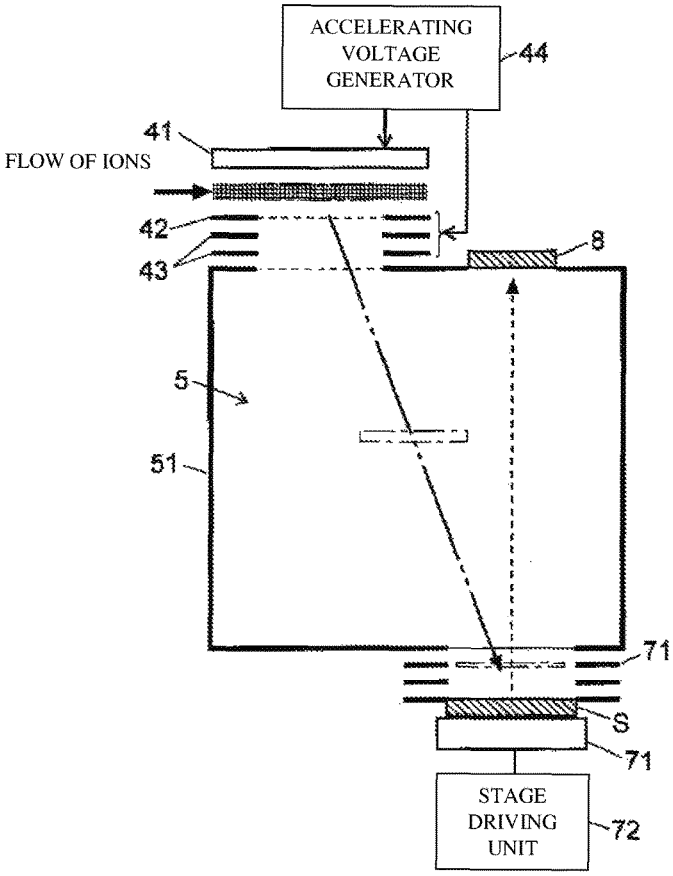
FIG. 12 is a schematic diagram of the beam guiding unit of TOF-SIMS according to another example of embodiment using the ion radiation device of the present invention.

The easiest configuration to use as the ion beam guiding unit 3 is an ion optical system equivalent to the linear TOFMS using a dual stage acceleration-type ion source that fulfills Wiley-McLaren conditions. This configuration is shown in FIG. 12. The primary ions are accelerated by an orthogonal acceleration unit 4 and introduced into the flight space 5, and the primary ions that fly in the flight space 5 are made to arrive on the surface of the sample S, which is completely the same as that in the example of embodiment described above. As has been described before, in this case, since only the first order time focusing is achieved, the time focusing compared to the case of using the ideal reflectron considerably deteriorates.

As another configuration, a dual stage reflectron by Mamyrin can also be used in the ion beam guiding unit 3. This is equivalent to the case where a correction potential is not added to a base potential in the example of embodiment described above, which in this case, it is possible to achieve second order time focusing. Therefore, the time focusing is excellent as compared to the case of using Wiley-McLaren-type accelerator, while the time focusing deteriorates as compared to the case of using the ideal reflectron.

In such TOF-SIMS of the present example of embodiment, ion optical systems in various time-of-flight mass separators configured so as to improve the time focusing of ions arrived at the detector in TOFMS can be used as the ion beam guiding unit 3.

In the TOF-SIMS of the example of embodiment described above, since the primary ion beam incident to the orthogonal acceleration unit 4 in the Z axial direction is cut-out only at a predetermined length in the Z axial direction to be accelerated, when the ion beam is supplied continuously to the orthogonal acceleration unit 4, the use efficiency of the ions decreases due to issues in the orthogonal acceleration unit 4, the so-called dual cycle. That is, there will be a large amount of ions discarded without being used for ion radiation. This is the same as in the case of TOFMS of orthogonal acceleration technique (refer to Non-Patent Literature 4). Therefore, in order to improve the use efficiency of ions at the orthogonal acceleration unit 4, the ions may be temporarily captured by the action of an electric field (or a magnetic field) in the mass selection unit 2, the accumulated ions may be send to the orthogonal acceleration unit 4 in a packet form, and an orthogonal acceleration may be performed by adjusting the timing with the feeding of ions. For example, a linear-type ion trap, or the like, may also be used to accumulate the ions.

In order to adjust the position of the region irradiated by the primary ions on the surface of the sample S, as for the Z axial direction, the initial kinetic energy imparted to the ions at the time of introducing the ions to the orthogonal acceleration unit 4 (that is, the energy in the Z axial direction possessed by the ions introduced to the orthogonal acceleration unit 4) may be adjusted. As for the position in the Y axial direction, adjustment cannot be done even when the initial kinetic energy is changed, so the deflection electrode for deflecting the ions incident to the orthogonal acceleration unit 4 in the Y axial direction are disposed right before the orthogonal acceleration unit 4. By doing so, it is possible to adjust or change the position of the region irradiated by the primary ions on sample S without moving within the Y axis-Z axis surface the sample stage 71 on which the sample S is placed.

In the example of embodiment described above, tilting the sample stage 71 secures the parallelism between the surface of the sample S and the spread surface of the ion packets incident to the surface; however, in place of mechanically tilting the sample stage 71, the spread surface of the ion packets at the time of emission in the orthogonal acceleration unit 4 may be tilted instead. For this reason, a beam deflector may be provided in front of the orthogonal acceleration unit 4 so as to slightly tilt the incident direction of the ions incident to the orthogonal acceleration unit 4 by the beam deflector with respect to the YZ surface. Or, it is possible to adjust the parallelism between the surface of the ion packets and the surface of the sample S also by adjusting the applied voltage to the push-out electrode 41 or the extraction electrode 42 at the time of introducing the ions to the orthogonal acceleration unit 4. Also in this case, similarly to the description above, a user may adjust the width of the peak having a specific mass-to-charge ratio in the secondary ion spectrum to be as small as possible while observing such width.

In the example of embodiment described above, a mass selection unit 2 is provided in front of the orthogonal acceleration unit 4 to align the mass-to-charge ratios of the primary ions; however, in place of this mass selection unit 2, an opening and closing blind (refer to Non-Patent Literature 4) by an electric field may be provided inside the flight space 5 of a non-electric field, and ions with a predetermined mass-to-charge ratio may be selected by this blind.

In the examples of embodiment described above, the ion radiation device of the present invention was applied to TOF-SIMS by means of projection-type binding technique, and the secondary particles subjected to measurement were the separated ions emitted from the surface of the sample S. However, the ion radiation device having the same configuration can be used in various types of surface analyzers in which primary ions in a very thin sheet shape are uniformly irradiated to a somewhat wide range on the surface of the sample S, and depending on this, various types of particles, electromagnetic waves, and so on, other than the ions emitted from the sample S are observed. For example, surface analyzers for observing light, x-rays, neutral particles, and the like, emitted from the sample S depending on the ion radiation can be typically used. To be more specific, it is possible to apply to surface analyzers for uniformly irradiating primary ions to a solid surface with a different spatial distribution and measuring the light or the separated particles at a time resolution of nanoseconds by a chemical reaction on the solid surface.

A transmission-type analyzing technique of irradiating ions to a sample in a thin sheet form and observing the ions that are emitted after passing through the sample (secondary ions) can also be considered. In short, the present invention can be applied to all surface analyzers that use ions in a sheet form as the primary particles and observe ions such as molecules, atoms, photons as well as metastable particles as the secondary ions.

The present invention is also useful not only for TOF-SIMS according to the projection-type imaging technique and other surface analyzers but also for TOF-SIMS according to the scanning-type imaging technique and other surface analyzers.

The present invention is not limited to the examples of embodiment and various modification examples described above; it shall be readily understood that proper modifications, corrections, and additions are also included within the range of the Scope of Patent Claims.

EXPLANATION OF REFERENCES

1 . . . Ion source
2 . . . Mass selection unit
3 . . . Ion beam guiding unit
4 . . . Orthogonal acceleration unit
41 . . . Push-out electrode
42 . . . Extraction electrode
43 . . . Accelerating electrode
44 . . . Accelerating voltage generator
45 . . . Acceleration space
5 . . . Flight space
51 . . . Housing
6 and 102 . . . Ion reflector
61 . . . Guard ring electrode
62 . . . Back plate
63 . . . Reflection voltage generator
7 . . . Sample holding part
71 . . . Sample stage
72 . . . Stage driving unit
8 . . . Time-of-flight mass analyzer
81 . . . Accelerating electrode
82 . . . Flight space
9 and 103 . . . Detector
10 . . . Data processor
S . . . Sample
100 and Pa . . . Accelerating region
101 . . . Non-electric field flight space
Pb . . . Reflecting region
Pc . . . Sample holding region

What is claimed:

1. An ion radiation device for irradiating ions to a surface of a sample, comprising:

a) a beam formation unit for forming an ion beam consisting of ions having the same mass-to-charge ratio, and b) an ion beam guiding unit for pulsing the ion beam formed by the aforementioned beam formation unit and guiding the beam to the surface of the sample;

wherein the ion beam guiding unit includes b1) an orthogonal acceleration unit for accelerating the incident ion beam in pulses in the direction substantially orthogonal to its travelling direction, b2) a flight space in which the ions accelerated by the orthogonal acceleration unit fly, and b3) a voltage generator for applying a predetermined accelerating voltage to the orthogonal acceleration unit and/or applying a predetermined voltage to an ion reflector arranged in the flight space and in which ions are reflected by the action of the electric field, so as to allow the time focusing of ion packets accelerated by the aforementioned orthogonal acceleration unit, fly in the flight space, and arrived on the surface of the sample.

2. The ion radiation device according to claim 1, characterized in that the aforementioned ion beam guiding unit includes an ion reflector, and the aforementioned voltage generator applies a predetermined voltage to the aforementioned ion reflector so that the potential gradient on the ion optical axis in the reflecting electric field by the aforementioned ion reflector becomes non-linear at least in some portions.

3. The ion radiation device according to claim 2, characterized in that the aforementioned voltage generator applies a voltage to the ion reflector so that a predetermined potential distribution UA (X) with which an inverse function XA (U) is uniquely obtained is formed in the hollow region of the ion reflector, after the potential is monotonically changed over the entire ion reflector along the central axis of the ion reflector, when X is set as the coordinate along the central axis of the ion reflector, thereby, forming an Nth order focusing position at the position of coordinate X0 and potential E0 inside the ion reflector, and at the same time applies a voltage to the ion reflector so as to superimpose on the predetermined potential XA (U) a predetermined correction potential XC (U) that becomes a smooth function at the back side from the coordinate X0 and can be approximated by the equation in proportional to $\{U(X)-E_0\}$ N+3/2 in the vicinity of the coordinate X0 in a space at the back side where an Nth order focusing position with coordinate X0 is set as the starting point.

4. The ion radiation device according to claim 1, characterized in that the aforementioned ion beam guiding unit includes a dual stage ion reflector that fulfills Mamyrin solution.

5. The ion radiation device according to claim 1, characterized in that the aforementioned orthogonal acceleration unit carries out acceleration according to a dual-stage acceleration technique that fulfills Wiley-McLaren condition.

6. The ion radiation device according to claim 1, characterized in that the aforementioned beam formation unit includes at least one of a liquid metal ion source, a cluster ion source, a gas field ion source, or an ion source using electric discharge.

7. The ion radiation device according to claim 1, characterized in that the aforementioned beam formation unit includes a selection unit for selecting ions having a specific mass-to-charge ratio.

8. The ion radiation device according to claim 1, characterized in that the ion beam guiding unit further has a centroid adjustment unit for adjusting the spatial centroid of the ion beam.

9. The ion radiation device according to claim 1, characterized in that the beam formation unit has an ion storage unit for storing ions, wherein the ions temporarily stored in the ion storage unit are emitted and introduced to the orthogonal acceleration unit.

10. The ion radiation device according to claim 1, characterized in that the beam formation unit irradiates ions having two-dimensional spread to a sample by allowing incident of an ion beam with a predetermined width on the orthogonal acceleration unit, the ion beam of which spreads in the direction substantially orthogonal to both the incident direction of ions to the orthogonal acceleration unit and the acceleration direction in the orthogonal acceleration unit, and by allowing the orthogonal acceleration unit to accelerate in pulses only at a predetermined length the incident ion beam with a predetermined width in its incident direction.

11. The ion radiation device according to claim 10, characterized in that a sample stage is provided to hold a sample, wherein the sample stage is made to be slidable and tiltable.

12. A surface analyzer using the ion radiation device according to claim 1, characterized in that the surface analyzer is used to observe ions, neutral particles, photons, or phonons emitted as secondary particles from a sample with respect to the ions that are made incident to the surface of the sample by the aforementioned ion radiation device.

13. The surface analyzer according to claim 12, characterized in that the surface analyzer is a time of flight-type secondary ion mass analyzer for measuring the secondary ions emitted from a sample by a time of flight-type mass analyzer.

* * * * *